US006385826B1

(12) United States Patent
Tanaka et al.

(10) Patent No.: US 6,385,826 B1
(45) Date of Patent: May 14, 2002

(54) SAMPLE WARPER WITH DETECTOR FOR YARN ON YARN GUIDE

(75) Inventors: Yoshihiro Tanaka; Takatsugu Aihara, both of Kiryu (JP)

(73) Assignee: Suzuki Warper Ltd., Kiryu (JP)

( * ) Notice: Subject to any disclaimer, the term of this patent is extended or adjusted under 35 U.S.C. 154(b) by 0 days.

(21) Appl. No.: 09/867,384

(22) Filed: May 31, 2001

(30) Foreign Application Priority Data

Aug. 22, 2000 (JP) ..... 2000-250723

(51) Int. Cl.[7] ..... D02H 3/00
(52) U.S. Cl. ..... 28/192
(58) Field of Search ..... 28/190, 191, 184, 28/193, 192, 195, 194

(56) References Cited

U.S. PATENT DOCUMENTS 4,972,562 A * 11/1990 Tanaka et al. ..... 242/472.8
5,590,448 A * 1/1997 Lenzen et al. ..... 28/191
5,630,262 A * 5/1997 Tanaka ..... 28/184
5,956,827 A * 9/1999 Vier ..... 28/191
5,970,591 A * 10/1999 Tanaka et al. ..... 28/184
6,173,480 B1 * 1/2001 Tanaka ..... 28/190

* cited by examiner

*Primary Examiner*—Danny Worrell
(74) *Attorney, Agent, or Firm*—Arent Fox Kintner Plotkin & Kahn, PLLC

(57) ABSTRACT

A sample warper including a plurality of yarn guides, rotatably mounted on one side surface of a warper drum, for winding a plurality of yarns on the warper drum, a yarn selector mounted on a base supporting the warper drum for supplying the individual yarn selectively to one of the yarn guides and receiving selectively the yarn from one of the yarn guides, and a rotary creel supporting a plurality of bobbins of various kinds and/or a single kind of yarns. To detect a trouble, such as mis-winding or double-yarn-winding, the sampler warper is equipped with a yarn detector disposed adjacent to the peripheral edge of the warper drum for detecting whether or not the individual yarn is caught by the associated yarn guide, thereby confirming transferring of the yarn between said yarn guide and said yarn selector so that the yarns are successively wound neatly on said warper drum in preset yarn order.

2 Claims, 6 Drawing Sheets

SAMPLE WARPER WITH DETECTOR FOR YARN ON YARN GUIDE

BACKGROUND OF THE INVENTION

1. Field of the Invention

This invention relates to a sample warper for winding a plurality of yarns, which are payed out from a plurality of bobbins of various kinds and/or a single kind of yarns supported on a rotary creel, on a warper drum as the yarns are selected in preset pattern data (yarn order).

2. Description of the Related Art

As a conventional sample warper (W), there has been known a structure shown in FIGS. 4–6, disclosed in Japanese Patent No. 1529104, etc. The sample warper W of FIG. 4 comprises: a warper drum (A); a single yarn guide 6, rotatably mounted on one side surface of the warper drum (A) for winding a yarn on the warper drum (A); a plurality of yarn selection guides 27 associated with the yarn guide 6 and mounted on an end of a base (Y) supporting the warper drum (A) for moving angularly movable to project to a yarn exchanging position and retract to a standby position during yarn changing; a fixed creel (B) for supporting a plurality of bobbins (N) which are associated with the plural yarn selection guides 27 and on which the same kind or different kinds of yarns 22 are to be wound, thereby passing the yarns 22 between the yarn guide 6 and the yarn selection guides 27 so that the yarns are automatically changed and successively wound neatly on the warper drum (A) according to preset pattern data(yarn order).

In the sample warper (W), the plural yarn selection guides 27 receive the plural yarns 22, respectively, so that the individual yarns 22 of the fixed creel (B) can be successively wound on the warper drum W in a fully controlled manner. Reference numeral 17 designates a plurality of conveyer belts movably mounted on a circumferential surface of the warper drum (A). A feed rate of the conveyor belt 17 is controlled by a conveyor belt feed means, that is, a conveyor belt feed motor later described. A plurality of parallel shedding members (a plurality of parallel shedding bars 38*a*–38*g*) longitudinally extending alongside of the warper drum (A).

This known sample warper (W) has a hollow shaft 1 (FIG. 5). Driving and driven shafts 2, 3 project centrally from opposite ends of the hollow shaft 1. A small gear 5 fixed to a pulley 4 and a pulley 99 are loosely mounted on the driving shaft 2, while a small gear 7, to which a yarn guide 6 is fixed, is loosely mounted on the driven shaft 3 at the distal end. While the illustrated example shows only one yarn guide 6, two or more yarn guides 6 must be disposed for a plural-winding system as shown in Japanese Patent No. 1767706, EP 0375480 and U.S. Pat. No. 4,972,562, which enables not only winding a plurality of yarns concurrently on a warper drum without any time loss in exchanging yarns but also reducing the total warping time by the use of a rotary creel and the omission of the yarn exchanging step.

The small gears 5, 7 are associated with each other through small gears 9, 10 disposed at opposite ends of an associating shaft 8 extending through the hollow shaft 1, which small gears 9, 10 are meshed with the corresponding small gears 5, 7. The hollow shaft 1 is cantilevered at the driving shaft 2, and a warper drum A is loosely mounted on the hollow shaft 1 on the driven shaft 3 side.

The warper drum (A) is formed of drum frames 13, 14 having an outer periphery of like shape having alternately an arcuate portion and a straight portion; a pair of rollers 15 disposed one on the arcuate portion of each of the drum frames 13, 14; and horizontal beams 16 carrying the rollers 15 around which conveyor belts 17 are wound. The conveyor belts 17 are moved along a plane formed by the horizontal beams 16.

The conveyer belts 17 are simultaneously driven to a common amount of fine movement by a drive member 21 threadedly engaged with interior screw shafts 20 of planetary gears 19 concurrently rotated by meshing with a sun gear 18 suitably driven from the exterior. A feed rate of the conveyor belt 17 may be controlled by a control unit controlling a conveyor belt moving motor 51 later described, that is, a conveyor belt feed means. The distal end of the yarn guide 6 is bent inwardly to provide a yarn guide part 6' which is disposed adjacent to the front end of the outer periphery of the warper drum (A).

Referring to FIG. 5, (B) designates a fixed creel for supporting a plurality of bobbins around which different kinds (different colors or different twists) of yarns 22 are wound; 24, a guide plate for guiding yarns 22 drawn out from the bobbins; 25, a tension regulator for regulating the tension of the yarns 22; 26, a dropper ring; 30, a guide rod for the yarns 22; and (E), a yarn fastener having a permanent magnet mounted to a base (Y) for pressing and setting the yarns.

Referring again to FIG. 5, reference numeral 46 designates a main motor implemented by an invertor motor for enabling, during operation of the warper, acceleration and deceleration, buffer start/stop, jogging operation and an increased winding speed.

Further in FIG. 5, reference numeral 47 designates a main speed change pulley; 58, a V belt wound on and between the main speed change pulley 47 and an auxiliary speed change pulley 48; 49, a counter pulley which is coaxial with the auxiliary speed change pulley 48; and 50, a brake actuating pinion for reciprocatingly moving a rack to bring the rack into and out of engagement with a brake hole (not shown) in a brake drum (D), thus controlling the warper drum (A) as desired. Reference numeral 57 designates a belt between pulleys 4 on the driving shaft 2; 51, a conveyor belt moving motor (AC servo motor); 52, a shift lever; 54 a sprocket-wheel; 55, a chain; 56, a chain wheel for driving the sun gear 18; 57, 58, both V belts; 59, a front cover; 59*a*, a front guide rod; and (D), the brake drum. Reference numerals 67*a*, 67*b* designate sensors for detecting the passing of the slit of the slitted plate 28.

Referring next to FIG. 6, reference numeral 69 designates a movement/stopping change-over lever for the conveyor belts 17; 70, a locking lever for locking the warper drum (A); 74, a shedding bar adjusting lever; 75, a shedding bar locking handle; 78, a program setting unit; 79, a controller; 80, a yarn tensioning unit located centrally on the straight part 12 of the warper drum (A); and (C), a rewinder.

The controller 79 is a control unit for controlling the sample warper and may control various apparatus connected thereto in accordance with a program set by a program setting unit 78. The basic structure and operation of the sample warper (W) are well known as by the above-mentioned Japanese Patent, etc., so their detailed description is omitted here. As the conveyor belt 17, needless to say, there may be applied an endless conveyor belt mechanism as disclosed in Japanese Patent Laid-open Publication No. 11-315439.

Creels to be used in electronically controlled sample warpers, are grouped into two of types, fixed creels and rotary creels, as mentioned above.

The fixed creel supports a plurality of bobbins of various kinds and/or a single kind of yarns (usually various kinds of yarns); since the yarns can be warped one by one, it is possible to realize warping of yarns in various desired patterns. But this one-by-one warping inevitably takes long time to complete the intended pattern. Meanwhile, the rotary creel also supports a plurality of bobbins of various kinds and/or a single kind of yarns; it is impossible to realize warping of yarns in various desired patterns except only a limited kinds of pattern warping, such as plain-cloth warping (e.g., only red yarns), 1×1 warping (e.g., repeating alternately a single red yarn and a single white yarn, or repeating alternately a single S-ply yarn and a single Z-ply yarn) and 2×2 warping (e.g., repeating alternately two red yarns and two white yarns, or repeating alternately two S-ply yarns and two Z-ply yarns). But with the rotary creel, since a plurality of yarns are wound on the warper drum concurrently, it is possible to reduce the total warping time by a considerable extent.

Specifically, the rotary creel is advantageous in warping warp yarns to weave a striped pattern cloth because it can reduce the total warping time to weave local plain-cloth portions of the striped-pattern cloth as compared to the fixed creel. But it is impossible to use the rotary creel in warping warp yarns to weave stripes of yarns different from those used in the plain-cloth portions; this necessitates to use the fixed creel instead. On the other hand, with the fixed creel, because the yarns are wound on the warper drum one by one to weave the local plain-cloth portions, it would take long time to complete the warping of yarns for the whole striped cloth, thus causing only a limited degree of warping efficiency.

Consequently, in an effort to improve the efficiency of composite warping for a striped cloth locally having striped-cloth portions and plain-cloth portions by reducing the total time for winding yarns on a warper drum, the present inventor(s) proposed an electronically-controlled sample warper as disclosed by Japanese Patent Laid-Open Publication No. 11-9175. This sample warper comprises a warper drum, a plurality of yarn guides rotatably mounted on a side surface of the warper drum for winding a plurality of yarns on the warper drum, a yarn guide part mounted on a tip end of the yarn guide for guiding the yarns, and a yarn selector mounted on an end of a base, which supports the warper drum, in confronting relation to the yarn guide means and angularly movable to project into a yarn exchanging position and retract into a waiting position. The sample warper further comprises a fixed creel and a rotary creel, each supporting a plurality of bobbins of various kind and/or a single kind of yarns associated with the yarn selector, for automatically exchanging the yearns and winding the yarns on the warper drum in preset yarn order as the yarns are transferred between the yarn guide means and the yarn selector.

Further, the present inventor(s) proposed two sample warpers to carry out warping of a various kinds of yarns in an reduced time to perform a variety of kinds of pattern warping by exchanging the various yarns with the rotary creel in a flexible manner varying according to the designated pattern, as disclosed as Japanese Patent Laid-Open Publication No. 2000-076720. The first sample warper comprises a warper drum, a plurality of yarn guides rotatably mounted on a side surface of the warper drum for winding a plurality of yarns on the warper drum, a yarn selector mounted on an end of a base, which supports the warper drum, in confronting relation to the yarn guide and angularly movable alternately to project into a yarn exchanging position and retract into a standby position, a rotary creel removably supporting a plurality of bobbins of various kinds and/or a single kind of yarns, and a bobbin station where the individual bobbins are located as they assume the standby position. The first sample warper winds the yarns as the yarns are exchanged in preset yarn order by transferring the bobins between the rotary creel and the bobbin station in such a way that the bobbins of the yarns, which are wound on the warper drum, are supported on the rotary creel while the bobbins of the yarns, which are retracted into the yarn selector, are located in the bobbin station in the standby position. The second sample warper comprises a warper drum, a plurality of yarn guides rotatably mounted on a side surface of the warper drum for winding a plurality of yarns on the warper drum, a yarn selector mounted on an end of a base, which supports the warper drum, in confronting relation to the yarn guide and angularly movable alternately to project into a yarn exchanging position and retract into a standby position, a rotary creel removably supporting a plurality of bobbins of various kinds and/or a single kind of yarns, wherein the yarns are wound on the warper drum in preset yarn order as the yarns are transferred between the yam guide and the yarn selector.

However the above-mentioned sample warpers occasionally encountered the trouble that the yarn guide fails to catch or to release the corresponding yarn payed out from the associated bobbin (mis-changing), namely, the yarn cannot be supplied to the yarn guide corresponding to the angular position of the rotary creel, or the yarn guide catches a target yarn together with an extra yarn (double-yarn-winding). An apparatus for detecting this mis-changing and double-yarn-winding using a fixed creel is known by Japanese Patent No. 1529105.

SUMMARY OF THE INVENTION

With the foregoing problems in view, it is an object of the present invention to provide a sample warper in which the above-described troubles such as the mis-changing or double-yarn-winding can be detected by a yarn detector that detects whether or not a yarn is caught by a yarn guide.

In order to attain the above object, according to the present invention, there is provided a warper drum comprising: a warper drum, a plurality of yarn guides rotatably mounted on a side surface of the warper drum, for winding a plurality of yarns on the warper drum; a yarn selector mounted on a base supporting the warper drum, for supplying the individual yarn selectively to one of the yarn guides and receiving the yarn from the yarn guide; a rotary creel supporting a plurality of bobbins of various kinds and/or a single kind of yarns; and a yarn detector, disposed adjacent to a peripheral edge of the warper drum, for detecting whether or not the individual yarn is caught by the associated yarn guide, to thereby confirm transferring of the yarn between the yarn guide and the yarn selector so that the yarns are successively wound neatly on the warper drum in preset yarn order.

As a preferred feature, the yarn selector may include a set of light emitting and receiving elements, and guide means for directing the individual yarn to the optical path of a light beam emitted from the light emitting element.

Other objects and additional features of the present invention will be apparent from the following detailed description when read in conjunction with the accompanying drawings.

BRIEF DESCRIPTION OF THE PREFERRED EMBODIMENT

Preferred embodiments of the present invention will now be described with reference to the accompanying drawings. The present invention should by no means be limited to the illustrated embodiments, and various other changes or modifications may be suggested without departing from the gist of the invention.

Figure 1:
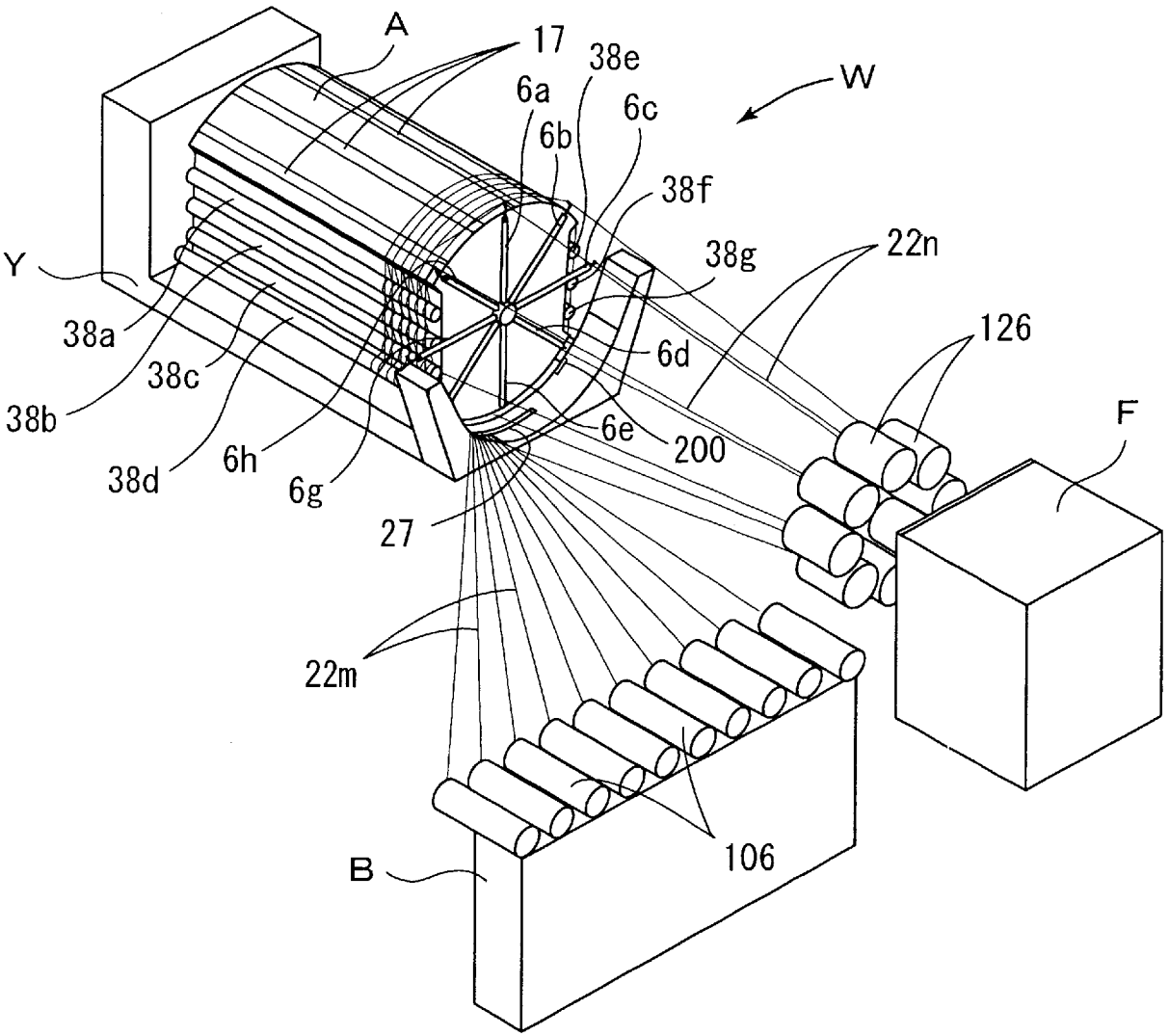
FIG. 1 is a perspective view of a sample warper according to an embodiment of the present invention.

In FIG. 1, a sample warper W according to an embodiment of the present invention comprises a plurality of (eight in FIG. 1) yarn guides 6*a*–6*h*, rotatably mounted on one side surface of a warper drum A, for winding yarns 22*m*, 22*n* on the warper drum A, a yarn selector 27, mounted on one end of a base Y, which supports the warper drum A, and angularly movable with respect to the yarn guides 6*a* through 6*h* alternately to project into a yarn exchanging position when exchanging the yarn and to retract into a standby position when accommodating the yarn, a fixed creel B supporting a plurality of bobbins 106 of various kinds and/or a single kind of yarns 22*m* arranged for cooperation with the yarn selector 27, and a rotary creel F supporting a plurality of bobbins 126 of various kinds or a single kind of yarns 22*n*. In the sample warper W, the yarns 22*m*, 22*n* are wound on the warper drum A as the yarns 22*m*, 22*n* are automatically exchanged in preset yarn order by transpiring the yarns 22*m*, 22*n* between the yarn guides 6*a* through 6*h* and the yarn selector 27.

Thus in the sample warper W of the embodiment, both the yarn 22*m* from the fixed creel B and the yarn 22*n* from the rotary creel F can be received in the yarn selector 27. This makes it possible to wind the yarns 22*m*, 22*n* successively on the warper drum A, as the need arises.

Reference number 17 designates a conveyor belt rotatably mounted on the circumferential surface of the warper drum A, and 38*a* through 38*g* designate shedding bars each having shedding means. Further, a rewinder (not shown) is provided adjacent to the sample warper W to rewind the yarn on the drum to a warp beam. The fundamental construction and operation of the sample warper W are widely known from the above-described Patent Publications, so their detailed description is omitted here.

Figure 2:
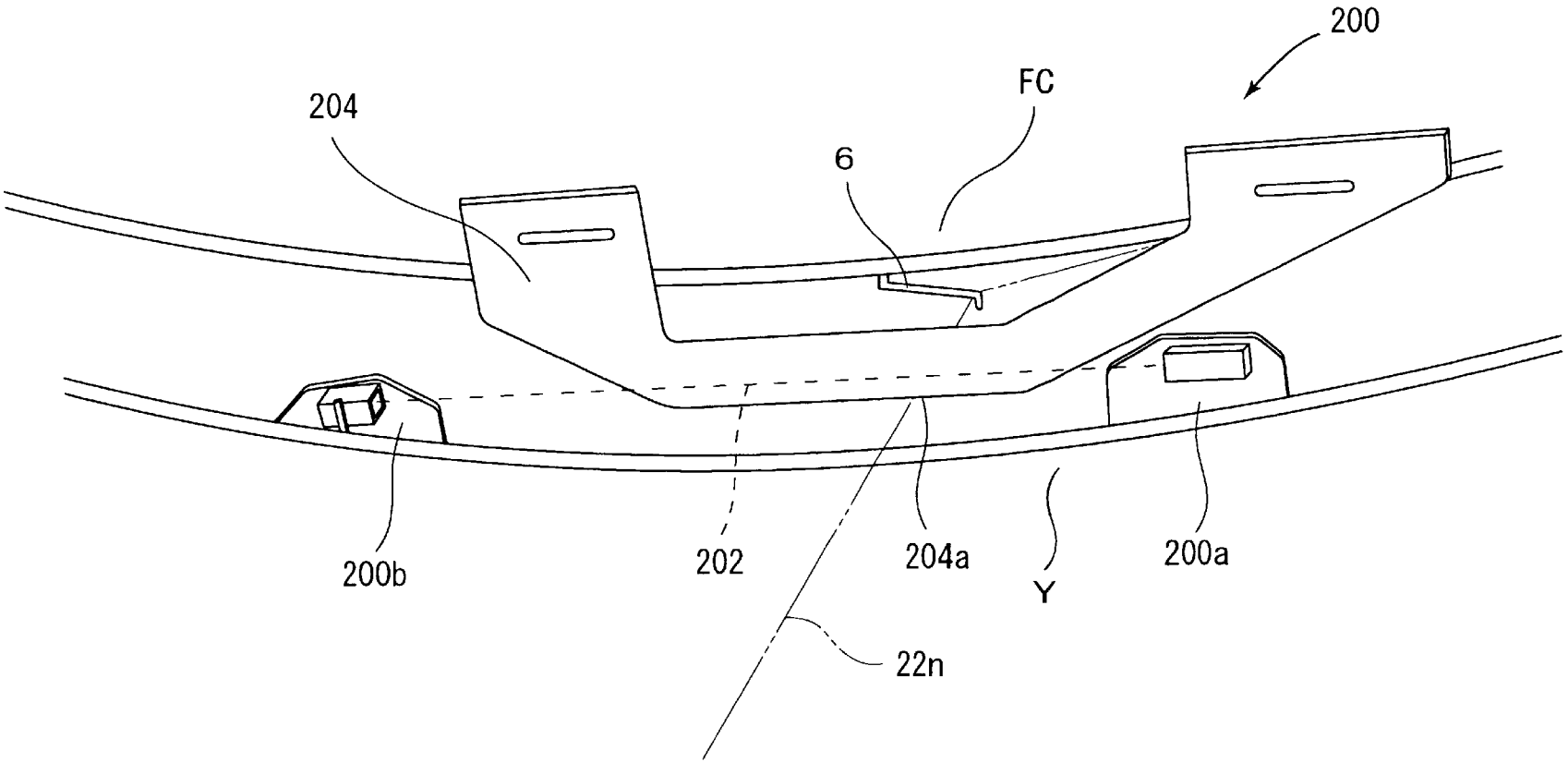
FIG. 2 is an enlarged view of a yarn detector of the sample warper of the embodiment.

As shown in FIGS. 1 and 2, reference numeral 200 designates a yarn detector disposed adjacent to a peripheral edge of the warper drum A and including a set of light emitting element 200*a* and light receiving element 200*b*, and guide means 204 for directing the individual yarn 22 to an optical path 202 of a light beam emitted from the light emitting element 200*a*. In FIG. 2, the light emitting element 200*a* and the light receiving element 200*b* are arranged on the upper edge of the base Y in confronting relation to each other. The guide means 204 is in the form of a guide board having a downwardly curved portion 204*a*, and opposite ends of the guide board are fixed to the front surface of the warper drum A and also to the circumferential edge of a front cover FC, which serves to cover the yarn guides 6*a* through 6*h*. The downwardly curved portion 204*a* guides the yarn 22 in such a way that the yarn 22 travels across the optical path 202 of a light beam. The yarn detector 200 detects the presence/absence of the yarn 22*n* by discriminating whether or not the yarn 22*n* supplied from the yarn guides 6*a*–6*h* travels across the optical path 202. Accordingly, if the yarn 22*n* is not caught by the yarn guides 6*a*–6*h*, the yarn detector 200 immediately detects that the yarn is not caught by the yarn. Thus a trouble, such as mis-changing or double-yarn-winding, is detected.

Figure 3:
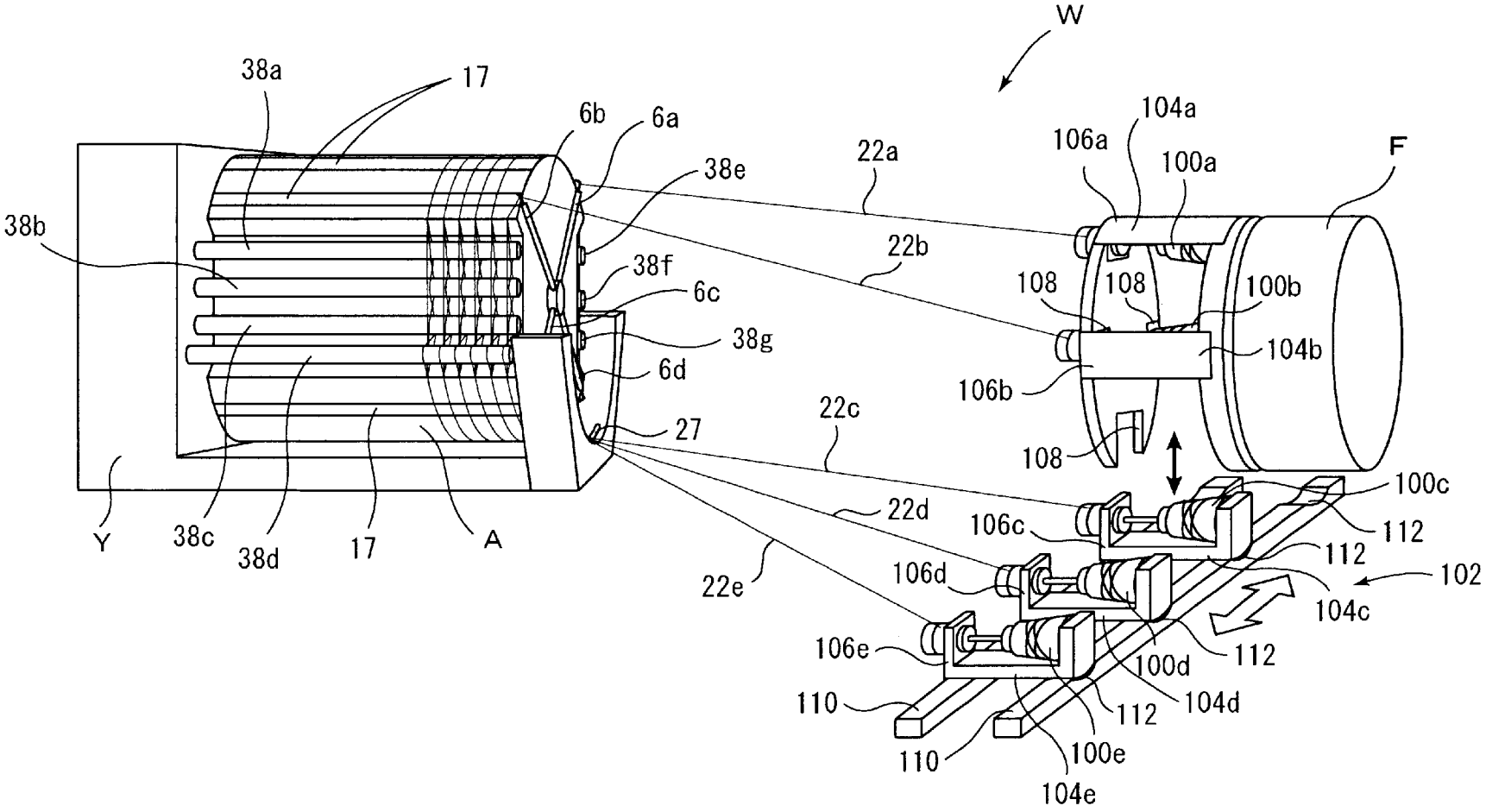
FIG. 3 is a perspective view of a modified sample warper according to another embodiment of the present invention.
Figure 4:
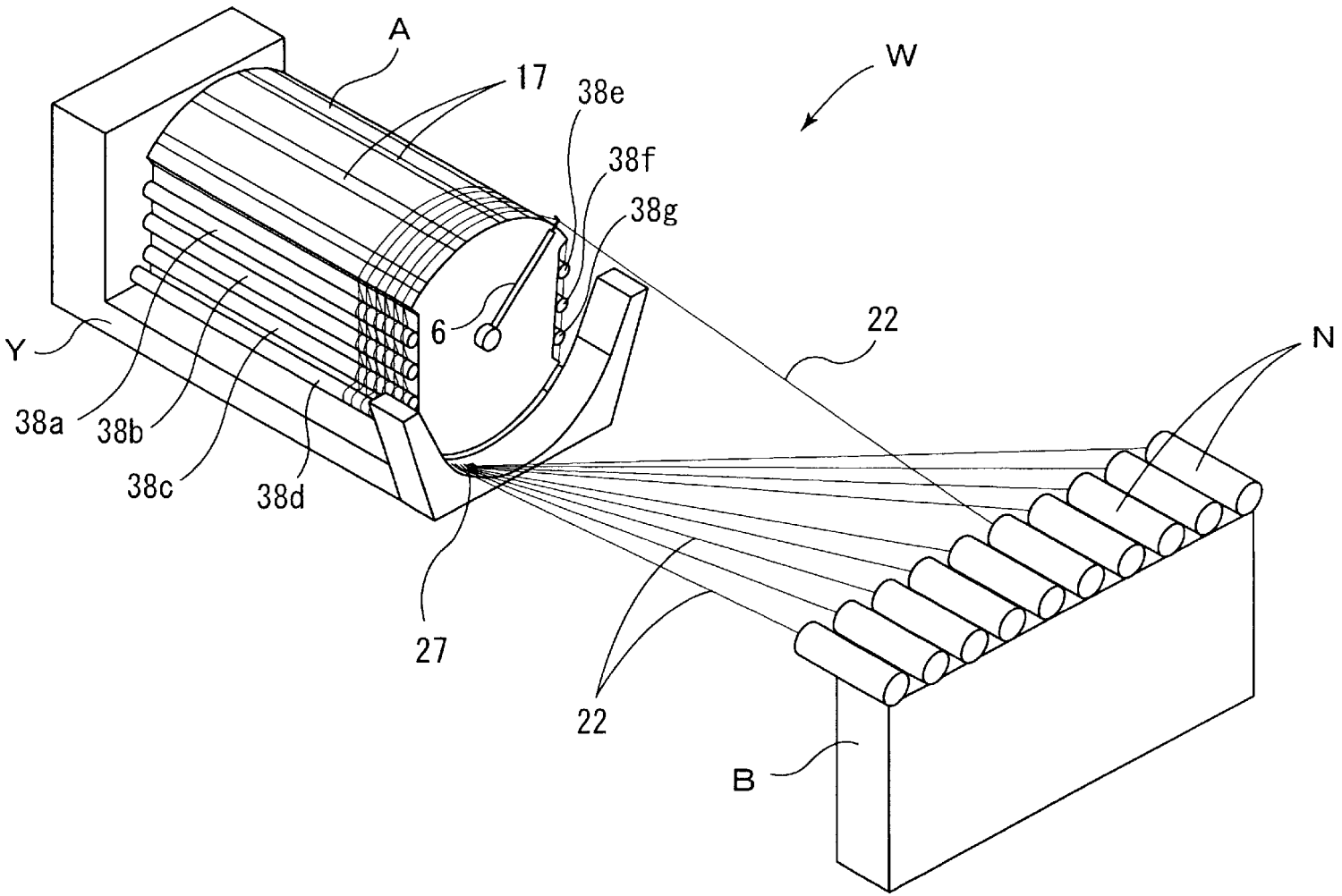
FIG. 4 is a perspective explanatory diagram showing a conventional sample warper.
Figure 5:
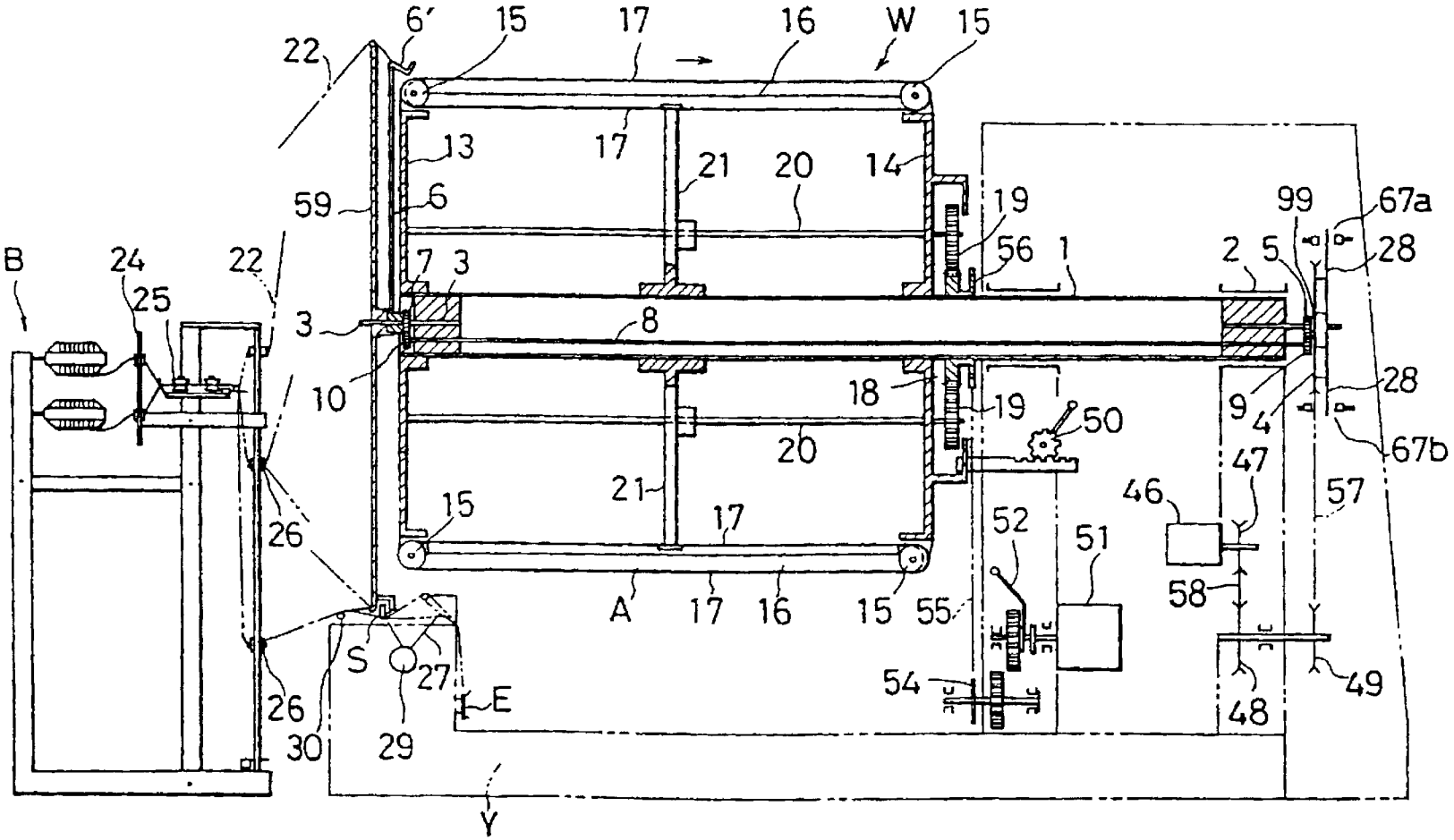
FIG. 5 is a schematic cross-sectional view of the conventional sample warper illustrated in FIG. 4.
Figure 6:
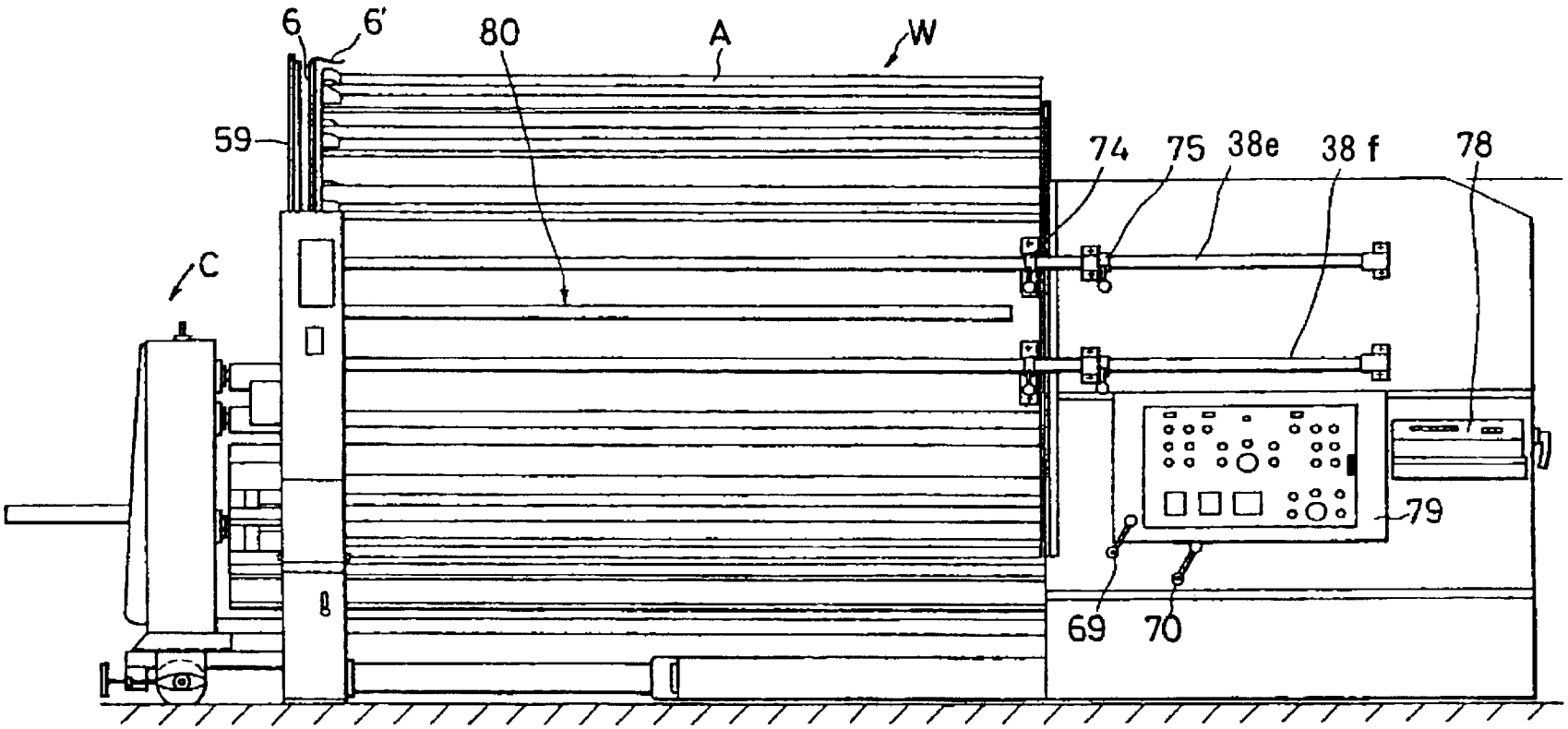
FIG. 6 is a schematic lateral view of the conventional sample warper illustrated in FIG. 4.

The yarn detector 200 of the embodiment is particularly useful when applied to the sample warper having the rotary creel F and the yarn selector 27. The yarn detector 200 is also useful when applied to another sample warper according to another embodiment shown in FIG. 3. The sample warper W of FIG. 3 is identical in construction with the sample warper W in FIG. 1 except that only the rotary creel F is provided while the fixed creel B is excluded and also that the sample warper W is equipped with a bobbin station 102. The rotary creel F is identical in function with that of FIG. 1, so repetition of the description is omitted here.

As an advantageous feature of the sample warper of FIG. 3, the bobbins 100*a* through 10*e* are detachably mounted on/in the rotary creel F and the bobbin station 102 so that the bobbins 100*a*–100*e* can be shifted from the rotary creel F to the bobbin station 102, and vice versa.

In FIG. 3, 104*a* through 104*e* designate bobbin bodies formed of bobbin frames 106*a* through 106*e*, on which bobbins 100*a*–100*e* are respectively supported, facilitate setting/releasing the bobbins 100*a*–100*e* to/from the bobbin station 102. The fundamental constitution of the rotary creel F is identical with that of the well-known rotary creel, except that the rotary creel of FIG. 3 has a plurality of (four in FIG. 3) bobbin receiving cutaways 108 (four in FIG. 3) in each of which one of the bobbin bodies 104*a*–104 is to be removably fitted.

The bobbin station 102 accommodates and detachably supports the plural bobbin bodies 104*a* through 104*e* in the standby position. In the embodiment shown in FIG. 3, the bobbin station 102 includes a pair of rails 110, 110 extending parallel to each other and a plurality of bobbin catchers 112 (four in FIG. 3), so that the bobbin bodies 104*a* through 104*e* are removably supported on the bobbin catchers 112 while assuming the standby position.

By making the bobbin station 102 (rails 110 in FIG. 3) movable, it is possible to facilitate transferring the bobbin bodies 104*a* through 104*e* to and from the bobbin receiving cutaways 108 of the rotary creel F. Further, it is preferable to use a well-known robot hand or the like when automatically transferring the bobbin bodies 104*a* through 104*e* according to preset pattern data (yarn order).

In the sample warper W of the embodiment of FIG. 3, like the sample warper W of the embodiment of FIG. 1, it is possible to quickly detect the troubles such as mis-changing or double-yarn-winding by the yarn detector 200.

As described above, according to the present invention, since troubles such as the mis-changing or the double-yarn-winding are detected immediately upon occurrence, it is possible to avoid possible secondary, significant troubles which might occur due to the mis-changing and/or double-yarn-winding.

Obviously, various minor changes and modifications of the present invention are possible in the light of the above teaching. It is therefore to be understood that within the scope of the appended claims the invention may be practiced otherwise than as specifically described.

What is claimed is:

1. A sample warper comprising:

a warper drum;

a plurality of yarn guides, rotatably mounted on a side surface of said warper drum, for winding a plurality of yarns on said warper drum;

a yarn selector, mounted on a base supporting said warper drum, for supplying the individual yarn selectively to one of the yarn guides and receiving the yarn selectively from one of the yarn guides;

a rotary creel removably supporting a plurality of bobbins of various kinds and/or a single kind of yarns; and a yarn detector, disposed adjacent to a peripheral edge of said warper drum, for detecting whether or not the individual yarn is caught by the associated yarn guide, to thereby confirm transferring of the yarn between said yarn guide and said yam selector so that the yarns are successively wound neatly on said warper drum in preset yarn order.

2. A sample warper according to claim 1, wherein said yarn selector includes a set of light emitting and receiving elements and guide means for directing the individual yarn to an optical path of a light beam emitted from said light emitting element.

* * * * *